US006521051B1

(12) United States Patent
Lutich

(10) Patent No.: US 6,521,051 B1
(45) Date of Patent: Feb. 18, 2003

(54) PORTABLE VACUUM STORAGE UNIT AND METHOD FOR USE

(75) Inventor: Louis L. Lutich, San Antonio, TX (US)

(73) Assignee: U.S. Liquids, Inc., Houston, TX (US)

( * ) Notice: Subject to any disclaimer, the term of this patent is extended or adjusted under 35 U.S.C. 154(b) by 0 days.

(21) Appl. No.: 09/544,576

(22) Filed: Apr. 6, 2000

(51) Int. Cl.[7] ..... A47L 9/22; B08B 5/04
(52) U.S. Cl. ..... 134/21; 15/319; 15/353
(58) Field of Search ..... 15/319, 353, 328, 15/248.1, 246.2; 134/21; 138/178

(56) References Cited

U.S. PATENT DOCUMENTS

| | | | | | |
|---|---|---|---|---|---|
| 2,528,375 | A | * | 10/1950 | Lilly | 15/353 |
| 3,343,199 | A | * | 9/1967 | Nolte | 15/319 |
| 4,054,149 | A | * | 10/1977 | Nelson | 15/304 |
| 4,185,354 | A | * | 1/1980 | Brazier | 15/353 |
| 4,246,676 | A | * | 1/1981 | Hallsworth et al. | 15/353 |
| 4,287,635 | A | * | 9/1981 | Jacobs | 15/353 |
| 4,306,558 | A | | 12/1981 | Kurtz et al. | 15/353 |
| 4,651,380 | A | | 3/1987 | Ogden | 15/321 |
| 4,654,926 | A | * | 4/1987 | McCambridge | 15/353 |
| 4,723,337 | A | * | 2/1988 | Ellison et al. | 15/353 |
| 4,763,694 | A | * | 8/1988 | Henderson | 138/178 |
| 4,987,975 | A | | 1/1991 | Liu | 184/105.1 |
| 5,032,155 | A | * | 7/1991 | Wiese et al. | 15/353 |
| 5,257,466 | A | | 11/1993 | Kishi | 34/95 |
| 5,267,370 | A | * | 12/1993 | Worwag | 15/353 |
| 5,438,721 | A | | 8/1995 | Pahno et al. | 5/604 |
| 5,465,455 | A | * | 11/1995 | Allen | 15/353 |
| 5,970,562 | A | * | 10/1999 | Lalevee, Sr. | 15/248.1 |
| 6,029,312 | A | | 2/2000 | Whitney | 15/347 |
| 6,073,666 | A | | 6/2000 | Clark, II | 141/83 |
| 6,110,383 | A | | 8/2000 | Coombs et al. | 210/732 |

* cited by examiner

*Primary Examiner*—Theresa T. Snider
(74) *Attorney, Agent, or Firm*—Baker Botts L.L.P.

(57) ABSTRACT

A liquids collection unit is provided for the collection of liquids, including spent grease in food preparation establishments. The unit includes a housing that surrounds a tank. Coupled to the tank are a suction hose and a motor, which creates a vacuum in the tank to draw liquid into the tank when the hose is disposed in liquid. The suction motor of the device is disposed on a detachable plate on the tank. Sensors located within the tank monitor the liquid level of the liquid in the tank. A down-tube from the detachable plate terminates in a dimpled protuberance in the bottom of the tank. A heating element disposed near the bottom of the tank provides for the circulation of liquids in the tank during periods when the liquids are being stored.

7 Claims, 3 Drawing Sheets

PORTABLE VACUUM STORAGE UNIT AND METHOD FOR USE

BACKGROUND OF THE INVENTION

The present invention relates in general to the field of recycling systems and more particularly to a system and method for the collection and storage of liquids, including liquid waste products, such as spent grease produced by food preparation establishments. In the commercial food preparation industry, issues relating to the generation, handling, and disposal of spent cooking grease are matters implicating critical environmental regulations, employee safety concerns, and cost considerations. Every restaurant, cafeteria, and commercial kitchen generates some amount of spent cooking grease and, therefore, must face these issues.

A common view of managing spent grease is to dispose of it as any other waste material. Oftentimes, this solution includes the practice of simply running the material down waste drainage pipes or disposing of the grease in common garbage dumpsters. Today, significant restrictions mandate a radical departure from such practices. Federal authorities, armed with the Clean Water Act, and most local authorities, empowered with similar legislation, have imposed strict requirements regulating the dumping of untreated waste materials. To comply with federal and local environmental laws, restaurants may turn to publicly owned waste treatment facilities that dispose of spent grease for a fee. As an alternative, restaurants may turn to local garbage disposal companies that manage dumpsters. Restaurants and other food preparation establishments frequently pay additional fees to these garbage disposal firms for the disposal of spent grease. As another alternative, restaurants may use contractors that are in the business of collecting and disposing of only spent grease.

Another factor governing the food preparation industry's handling of spent grease is the recognition that spent grease in high volumes is a valuable commodity and may be sold to recyclers who, in turn, sell to brokers for use in products such as feed additives. The market price that recyclers are willing to pay for spent grease fluctuates, as with any commodity. During periods of high demand, a restaurant may demand up to five cents per gallon from a recycler. During periods of low demand, there is little incentive for a recycler to pick up and resell the commodity, especially from restaurants that produce low volumes of the product. A recycler may even refuse to pick up spent grease at a restaurant unless the recycler is paid for its pickup and disposal service.

Faced with regulatory requirements and the economic effect of grease as a commodity, many restaurant establishments find it more advantageous to enlist the services of recyclers that specialize in collecting and selling spent grease. At the same time, many recyclers facing low grease prices are forced to improve their business practices in order to realize narrow profit margins in the business of recycling spent grease.

During periods of low demand for the commodity of spent grease, such as the present time, recyclers are able to make only modest capital investments. Recyclers seek to minimize the operational cost of collecting and processing spent grease while simultaneously increasing the volume of spent grease processed. To state the challenge facing recyclers in a different way, on each service trip that a recycler makes to a restaurant for pickup of spent grease, the volume of grease picked up must be sufficiently high, to justify the cost of the pickup and processing. Therefore, where volume is a determining economic factor in the recycling business, advancements in the collecting and recycling of the commodity become critical to recyclers.

Presently, recyclers that provide recycling services to restaurants typically request that a restaurant begin the process by manually removing spent grease from vats of frying appliances and by storing the spent grease in barrels typically located behind the restaurant. It is not uncommon for thieves to steal these barrels during periods when spent grease commands a high price. Other recyclers provide a restaurant with a portable vacuum machine that collects spent grease from frying appliances and stores the grease until such time that the recycler arrives for pickup. The use of these common portable vacuum machines has revealed numerous operational and safety pitfalls.

The most bothersome operational pitfall of current portable vacuums relates to serviceability. Current portable vacuums typically embody a design that requires the entire machine to be removed from a restaurant and to be disassembled when repair service is necessary. Removal of the machine disrupts and delays normal business operations in the restaurant. Further, the removal of a machine for repair generates additional labor and transportation costs to the recycler and may diminish the already slim profit margins of the recycler. Therefore, a need has arisen for a method of servicing portable liquid collection units without having to remove the whole machine from the restaurant and without having to disassemble the machine for every repair.

Another operational drawback of current portable vacuum units is that there is not a method for effectively heating during storage mode, when the grease is stored in the unit prior to pickup by the recycler. Know portable vacuum units may employ heating systems that are unreliable or that heat the grease to unnecessarily high temperatures, far above the temperature necessary to prevent the grease from coagulating. Another problem of heating the grease tank to an excessively high temperature is that doing so poses safety risks to operators, increases the energy cost to restaurants, and subjects the machines to excessive wear and tear.

Another common operational pitfall of known portable vacuum units concerns safety. In normal restaurant operations, many accidents are related to the exposure of restaurant personnel to hot grease and spilled grease. Many restaurant injuries are related to grease handling. Common problems occur, for example, when restaurant workers (1) spill hot grease, having temperatures as high as 350° F., on themselves while transferring grease from vats of frying appliances to storage barrels; (2) spill grease onto the floor, causing employees to slip and fall; or (3) spill grease onto the ground in the parking lot, causing customers of the restaurant to slip and fall. The effects of these problems raise significant safety concerns for restaurants and further add to the cost of insurance and workers' compensation coverage.

SUMMARY OF THE INVENTION

A portable liquids collection unit is provided that performs the functions of collecting, storing, and disposing of spent grease generated by restaurant establishments. The device includes a tank capable of storing a large quantity of spent grease, a vacuum motor to draw in grease, and a selection of components to monitor and control the liquid level and temperature inside the tank. The vacuum motor creates vacuum pressure in the tank, causing the suction of liquids into the tank when a suction hose from the tank is disposed in a liquid reservoir. The portable unit includes a detachable plate mounted on the top surface of the tank. Attached to the detachable plate are the suction motor and other components of the units that may require service from time to time. The serviceable components of the device are thus coupled to a detachable plate. A down-tube coupled to the plate terminates in a dimple formed in the tank. The dimple acts as a reservoir and a collection point for drawing fluid out of the tank. A heating pad or plate is disposed a distance in the tank and a distance above the bottom surface of the tank.

One advantage of the invention described herein is a portable liquids collection unit. For a heavy device that may hold hot materials, ease in moving the device is a highly desirable attribute for restaurant establishments and recyclers. Furthermore, by its design, which incorporates backup thermostats and a large heating pad conducive to high-convection currents, the device prevents coagulation of grease and requires less heat to maintain grease at desired temperature. The protruding dimple of the bottom surface of the tank provides an effective collection point for drawing liquids out of the tank.

Another advantage is that the invention utilizes operations that make it safer for all workers, including those at restaurant establishments and recyclers. The device uses vacuum pressure and a service wand to draw grease into an enclosed tank, providing a safe way for workers at restaurant establishments to capture spent grease. Moreover, the device prevents grease from flowing out of the tank and limits the volume of grease that could spill onto the floors on which workers may slip.

Another advantage is that the invention reduces the costs to recyclers in the business of collecting and disposing of spent grease The unit includes a detachable plate on which major components of the device are mounted, enabling the device to be serviced by removing only the minimum number of components and without removing the entire device from the establishment. Removal of the entire device from the food preparation establishment each time servicing was necessary would interfere with normal business operations of the restaurant and generate additional labor and transportation costs to the recycler.

Other advantages of the present invention will be apparent to those of ordinary skill in the art in view of the following specification, claims, and drawings.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The portable vacuum and storage device and method of use described herein concerns the collection and disposal of liquids. Food preparation establishments, including restaurants, need to dispose of spent grease, and recyclers are in the business of collecting, cleaning, and selling spent grease. The invention described herein is intended to fulfill the needs of both restaurant establishments and recyclers in the management of spent grease.

Figure 1:
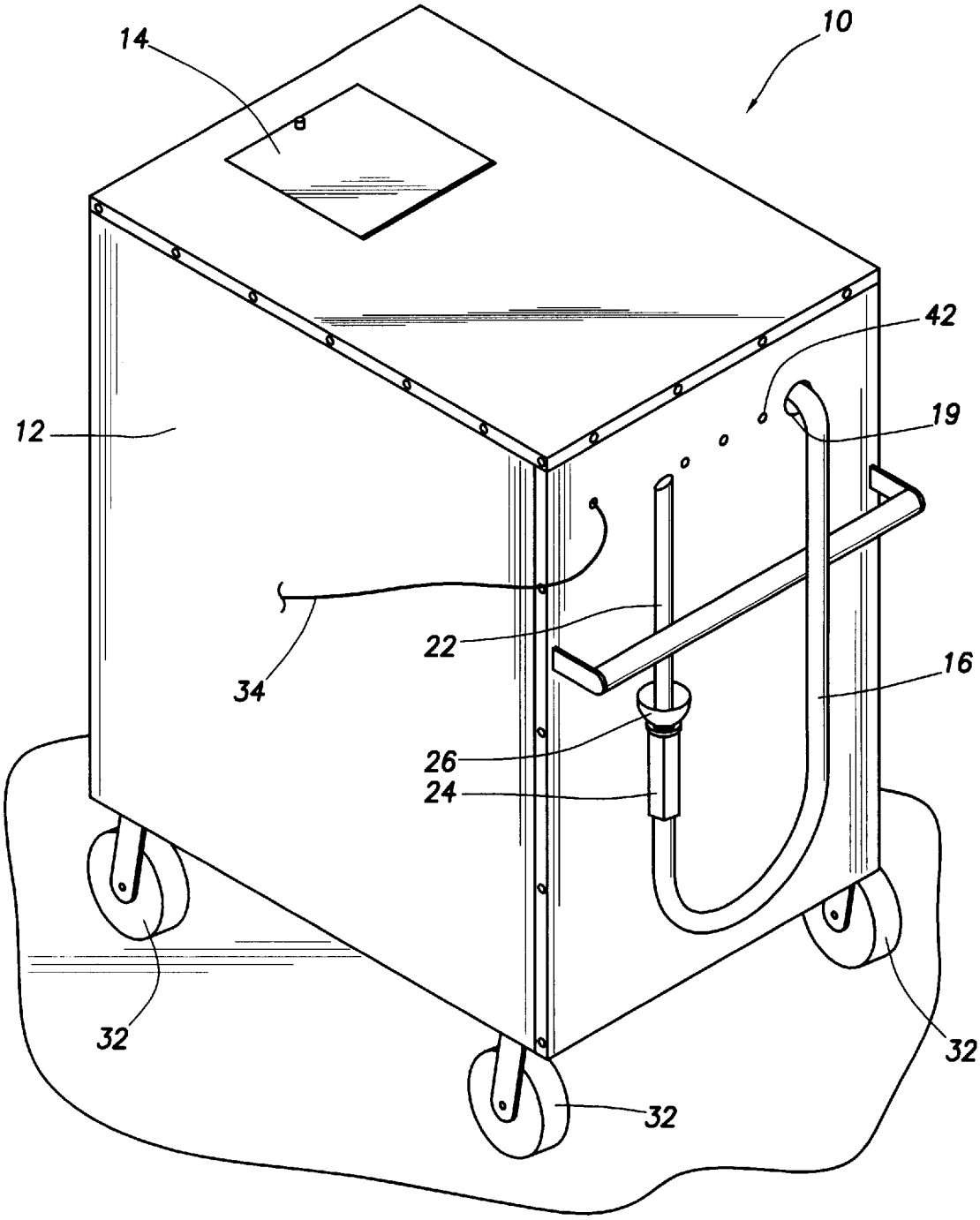
FIG. 1 is a depiction of the portable vacuum unit described herein.
Figure 2:
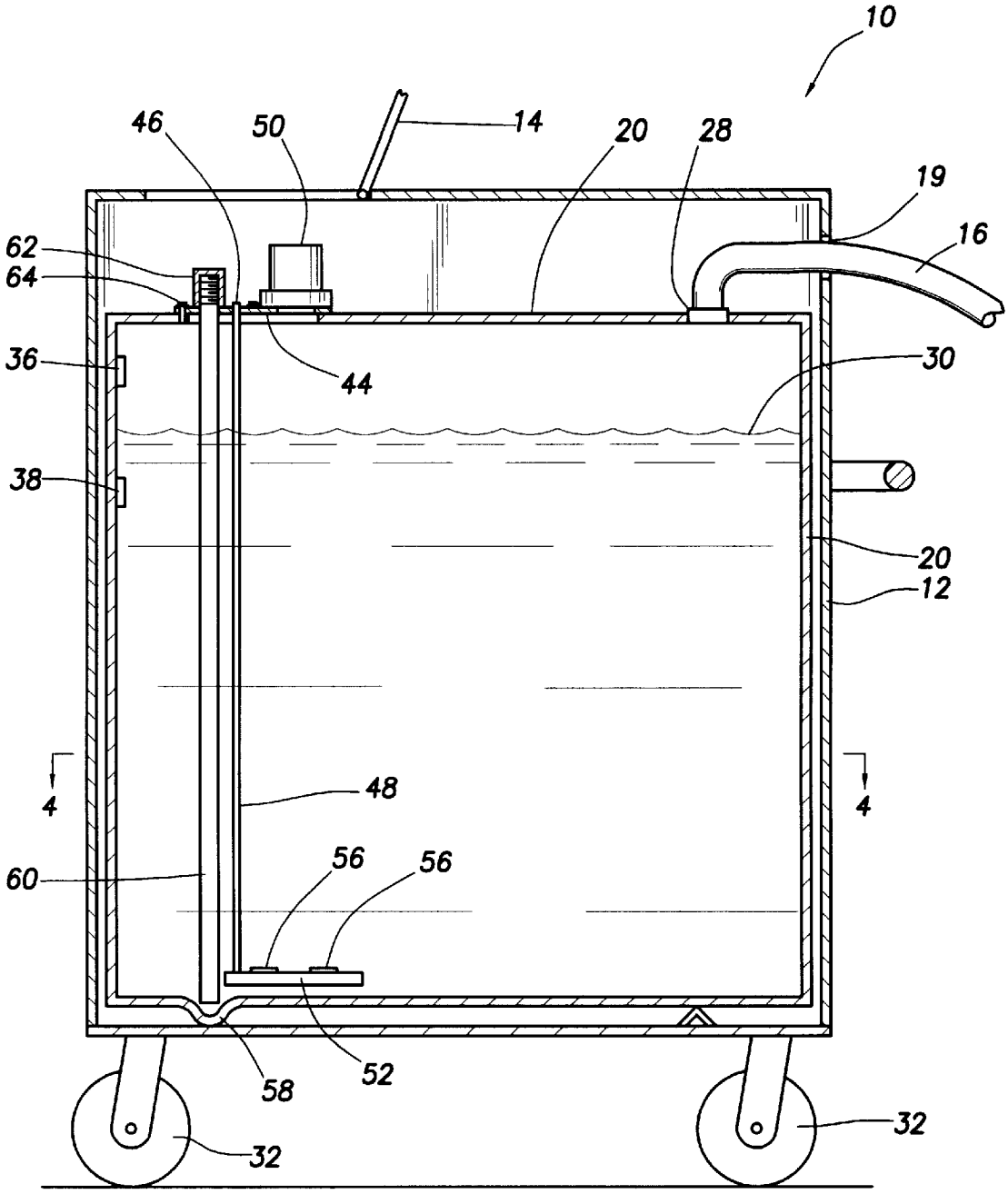
FIG. 2 is a cross-section of a side view of the device, displaying the internal tank, connections thereto, and other components described herein.

FIG. 1 and FIG. 2 depict an embodiment of the portable vacuum unit 10 of the present invention. The device 10 includes a stainless steel external housing 12 that includes a hinged lid 14 on the top surface of device unit 10. Hinged lid 14 pivots open and covers a pump and a set of electrical components. Service hose 16 is attached to the device through opening 19 of housing 12. Service hose 16 serves as a pickup tube to draw out grease from vats of kitchen fryers. Service hose 16 extends through stainless steel external housing 12 to attach to upper end of an internal tank 20, which is shown. in FIG. 2. Service hose 16 includes a high-temperature liner to accommodate the temperatures of the grease or other liquids sucked through the hose. Attached to the other end of service hose 16 is stainless steel service wand 22. A handle 24, made of synthetic rubber with low specific heat, is wrapped around wand 22, allowing the steel wand to be held by operators when the rubber of the hose is hot. Service wand 22 includes a small cup 26 designed to catch hot grease that may run down the outside of service wand 22. Cup 26, positioned between service wand 22 and handle 24, prevents grease from flowing down service wand 22 and onto hands of an operator of the portable vacuum unit.

As shown in FIG. 1, service hose 16 may be hung, pointing upward, at an orientation that does not allow liquid to drain from the hose. The end of service hose 16 is attached to tank 20 at a level 28 that is above the liquid level 30 of tank 20. An advantage of this design is that it prevents liquid from backflowing from the tank, so that even if the service hose 16 were dropped to the floor during use and power to the vacuum pump motor were disconnected, the maximum amount of grease spilled from the unit would be only the contents remaining in the service hose. Vacuum unit 10 is mounted on rotatable wheels 32, providing portability and easy maneuverability to the device. A retractable power cord 34 is connected to electrical components covered by hinged lid 14.

FIG. 2 shows level switches 36 and 38 inside tank 20. The level switches are coupled to circuits 40 of FIG. 3. Level switch 38 and corresponding circuitry operate light indicator 42 on the front of the housing 12 of the device to indicate that the grease within internal tank 20 has risen to an intermediate level. In this embodiment, the intermediate level is set at 80% of the full level. The second level switch 36 and its corresponding circuitry operate to prevent operators from drawing grease through service hose 16 into the internal tank beyond the full level of the tank. When level switch 36 is activated, its circuitry cuts off power to pump motor 50. When the full level of level switch 36 is reached, the power to the device is shut off, thereby preventing the operator from drawing additional fluid into the full tank.

Shown in FIG. 2 is a vacuum pump motor 50 positioned at the top of tank 20. The size of tank 20 is typically 120 gallons. The large size of the tank provides restaurant establishments with extended periods of use before requiring the services of a recycler. In operation, vacuum pump motor 50 creates a negative pressure within tank 20. The negative pressure created by vacuum pump motor 50 can draw grease through the service hose 16 into tank 20. In the embodiment described herein, the vacuum pump motor 50 generates vacuum rated at 100 inches of water.

Figure 4:
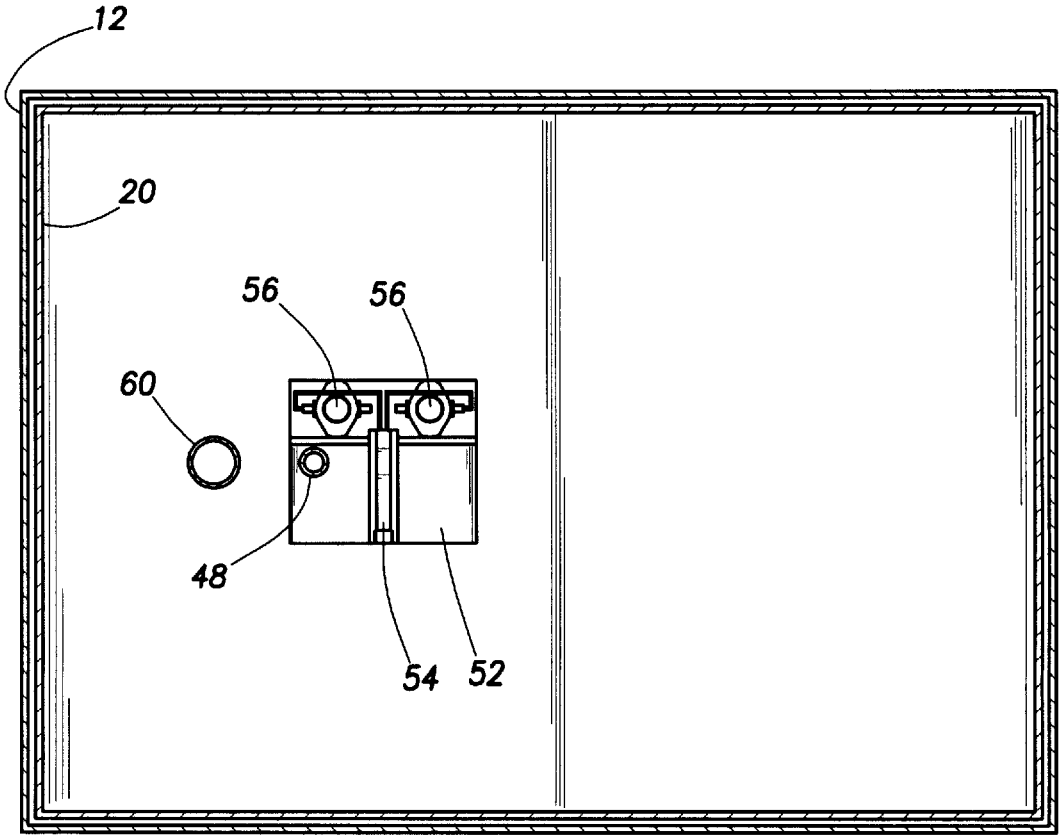
FIG. 4 is a cross-section of the device taken along line 4—4 of FIG. 2.

The vacuum pump motor 50 is mounted above and gasketed to the top surface of a detachable plate 44, which is positioned on top of the internal tank 20 and .below hinged lid 14. Plate 44 is fastened to the top of tank 20 by spring tension clips. Plate 44 also includes a plug 46. Attached to plug 46 is a conduit 48 leading to the bottom of the tank. Conduit 48 is shown in FIG. 2. The lower end of conduit 48 is connected to heating pad 52. Built into the heating pad is heating cartridge 54, which is shown in FIG. 4. The heating pad serves to keep the grease in tank 20:heated and to prevent the grease from coagulating. If the grease remains in a liquid form, it is more easily processed following storage. On the heating pad 52 and adjacent to the heating cartridge are double thermostats 56. The double thermostat configuration 56 regulates the temperature of heating pad 52 and provides built-in backup capability. Each thermostat 56, by itself, is capable of shutting off heater cartridge 54 and serves to back up each other to maintain desired temperature, which is typically around 120° to 140° F. Thermostats 56 are placed near the heater cartridges.

The placement of the thermostats near the heating cartridge enables the thermostats to efficiently regulate the temperature of the fluid in tank 20. In the embodiment described herein, the double thermostats 56 are inches away from heating cartridge 54. Heating pad 52 is mounted close to the bottom of, but not touching, tank 20. In the embodiment herein, heating pad 52 is mounted inches from the bottom of tank 20. This design permits heat to be distributed throughout of the, tank and requires less heat to maintain stored grease at desired temperature. Having a flat heating surface near the bottom of the tank also facilitates circulation of the stored grease. The heating pad 52 and the placement of heating pad 52 near, but not touching the bottom surface of tank 20 generates active convection currents, thereby aiding the circulation of the stored fluid in the tank and heating the liquid in the tank more efficiently and uniformly. The bottom of tank 20 is shaped with a steel dimple 58 the size of a coffee cup. Grease in tank 20 collects in protruding dimple 58, where the grease is collected through a down-tube 60. From the outside of the tank 20, this dimple looks like a blister on the bottom surface of tank 20. Down-tube 60 is positioned directly beneath a tank outlet cap 62. Dimple 58 facilitates the collection of grease at a collection point in tank 20 that only down-tube 60 can reach.

Figure 3:
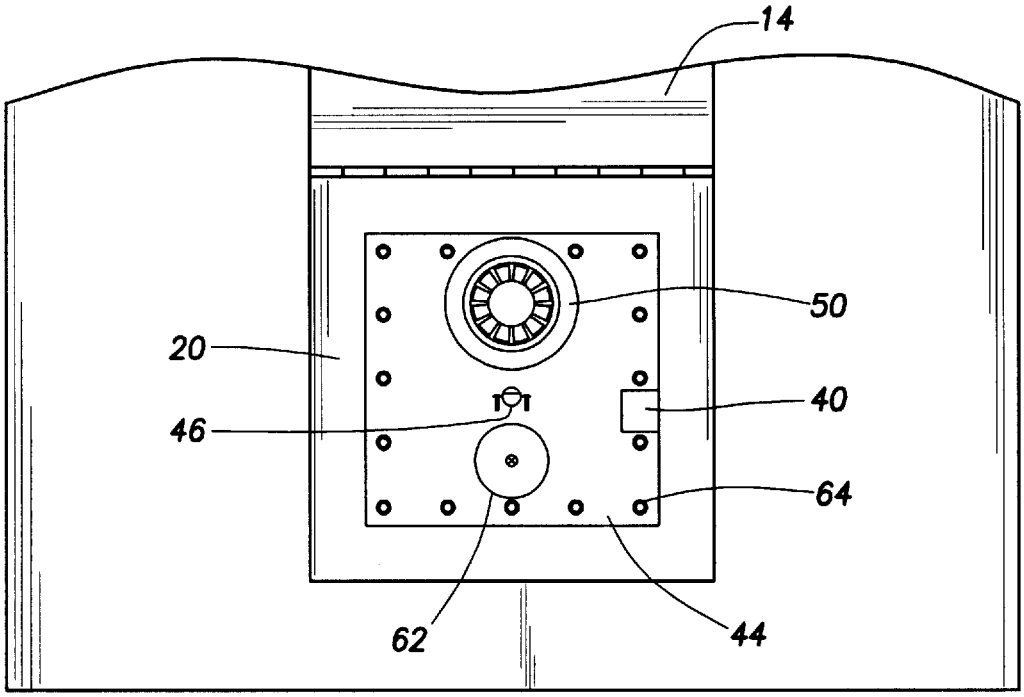
FIG. 3 is a plan view of a selection of components mounted on a bolted plate on top of the internal tank and covered by the hinged lid described herein.

FIG. 3 shows a selection of components mounted on plate 44, which is mounted on the top of internal tank 20. The main components comprise a vacuum pump motor 50, a number of relays, plug 46 attached to conduit 48, and cap 62 serving as a tank outlet for down-tube 60. The plate 44 on which these components are mounted is detachable by removing a number of bolts 64. Placing the motor 50 and the other serviceable components on detachable plate 44 improves the serviceability of unit 10. This configuration enables service workers to remove only the plate 44 to perform most service or repairs on the unit. Removing only plate 44 eliminates the necessity of removing the entire machine from the restaurant establishment when repairs are necessary. When these main components need to be replaced, only bolts 64 and plate 44 must be removed before a replacement plate or individual components can be installed. Thus, if a tank is deemed to be out of service because of a mechanical or an electrical failure, it is likely that the cause of the problem can be found in one of the items coupled to plate 44. The technician, upon visiting the food preparation establishment, can simply remove the existing plate 44, install a new plate 44, thereby allowing the restaurant to avoid serious disruption because of a faulty unit.

FIG. 4 shows a cross-section top view of the device. The internal tank 20 is covered by external housing 12. Down-tube 60 is capped at its upper end and is coupled to detachable plate 44, as shown in FIGS. 2 and 3. At its lower end, down-tube 60 terminates in a cavity formed by dimple 58. Conduit 48 is attached to plug 46 of FIG. 2 at the upper end, which is attached to the detachable plate 44 of FIGS. 2 and 3. At its lower end, conduit 48 leads to heating pad 52.

To operate the device, a restaurant operator wheels the portable device to the kitchen appliance having the vat of greased to be disposed. The operator turns on the power to the unit and dips service wand 22 into the vat of grease. Vacuum pump motor 50 establishes a vacuum in tank 20, enabling the wand 22 to suck grease from the vat into tank 20. When the tank level is filled to 80% of capacity, light 42 illuminates, indicating the level of fluid in the tank has reached an intermediate level. The operator may continue to draw grease into the tank until a full level is reached. When the full level is reached, power to vacuum pump motor 50 will be automatically terminated by circuitry 40 of FIG. 3. After suctioning the grease from the vat, the operator returns the portable unit to a storage area. At a later time, additional liquids may be suctioned into the tank if the tank is not full.

After drawing product into the tank, operators may place the device in storage on standby mode, whereby heating pad 52 of FIGS. 2 and 4 at the bottom of the tank prevents grease from coagulating. Operators may use the device at a later time until the tank is full. At such time, a recycler would be called to remove collected grease from the device. As an alternative to a call-in procedure, a recycler could visit restaurant establishments for grease removal according to a prearranged schedule. To remove collected grease from the internal tank, the recycler removes tank outlet cap 62, applies a vacuum to down-tube 60, causing the grease to draw out of tank 20 through down-tube 60. After the recycler removes the grease from tank 20, the restaurant establishment may resume using the portable vacuum and storage device at any later time. The recycler typically recycles the collected grease and markets the recycled product.

Although the present invention has been described in terms of the collection of spent grease generated by restaurant establishments, it should be recognized that the unit described herein may be used for the collection of other liquids in other contexts. The present invention provides for the collection of liquid products in a manner that is efficient, convenient, and safe for employees and operators of the device and may be used in any context in which liquid products are to be collected by a portable unit.

Although the present disclosure has been described in detail, it should be understood that various changes, substitutions, and alterations can be made hereto without departing from the spirit and the scope of the invention as defined by the appended claims.

What is claimed is:

1. A liquids collection unit, comprising:

a housing having a hinged door on a surface of the housing;

a number of wheels coupled to the housing;

a tank within the housing;

a plate detachably coupled to the top of the tank and accessible through the hinged door of the housing;

a heating element disposed in the tank;

a conduit coupling the heating element to the plate;

a suction motor coupled to the plate;

a suction hose coupled to the tank and extending from the housing;

wherein the activation of the suction motor when the suction hose is disposed in a liquid causes liquids to be suctioned into the tank;

wherein the liquids includes at least oil; and wherein the detachable plate permits the suction motor to be removed from the housing for service and to be replaced by a second detachable plate having a second suction motor coupled thereto.

2. The liquids collection unit of claim 1, wherein the heating element is in the form of a rectangular plate and includes two thermostats.

3. A liquids collection unit, comprising a housing having a hinged door on a surface of the housing;

a number of wheels coupled to the housing;

a tank within the housing;

a plate detachably coupled to the top of the tank and accessible through the hinged door of the housing;

a suction motor coupled to the plate;

a suction hose coupled to the tank and extending from the housing;

wherein the activation of the suction motor when the suction hose is disposed in a liquid causes liquids to be suctioned into the tank;

wherein the liquids includes at least oil;

wherein the detachable plate permits the suction motor to be removed from the housing for service and to be replaced by a second detachable plate having a second suction motor coupled thereto; and wherein the hose includes a handle and a liquids collection cup detachably mounted to the hose.

4. A method for collecting oil using a portable oil collection unit, comprising the following steps:

providing an oil collection unit, the oil collection unit comprising, a housing;

a tank located within the housing;

a heating element disposed in the interior of the tank;

an external hose coupled to the tank and extending from the housing;

a detachable plate coupled to the tank;

a suction motor coupled to the detachable plate, wherein the suction motor is operable to create vacuum pressure in the tank and wherein the detachable plate and suction motor may be removed from the housing for servicing of the suction motor; and wheels coupled to the housing;

positioning the housing near a source of oil to be collected;

placing the external hose in the source of oil to be collected; and activating the suction motor to create a vacuum in the tank such that oil is suctioned into the interior of the tank for collection.

5. An oil collection unit, comprising:

a housing having a hinged lid;

a tank disposed within the housing;

a plate detachably coupled to the tank and accessible through the hinged lid in the housing;

a hose coupled to the top of the tank and extending through an orifice in the housing;

a suction motor coupled to the plate;

a down-tube coupled to an orifice in the plate, the down-tube extending into the tank and terminating in a dimple formed in the bottom of the tank;

a shutoff sensor disposed in the tank and operable to transmit a signal to cause the suction motor to cease operation when the tank is full;

a heating element coupled to the plate via a conduit and disposed in the tank;

wherein the activation of the suction motor causes oil to be suctioned into the tank when the hose is disposed in oil.

6. The oil collection unit of claim 5, further comprising an intermediate sensor disposed in the tank and operable to transmit a signal when the oil level in the tank has reached a defined liquid level.

7. The oil collection unit of claim 5, wherein the shutoff sensor causes electrical power to be cut off from the suction motor.

* * * * *